United States Patent [19]

Panzer

[11] Patent Number: 4,580,751

[45] Date of Patent: Apr. 8, 1986

[54] SUCTION CUP SUPPORT PARTICULARLY FOR A SHOWER HEAD WITH HANDLE AFFIXED TO A SHOWER HOSE

[76] Inventor: Elinor S. Panzer, 8008 Fenton Rd., Phila., Pa. 19118

[21] Appl. No.: 628,206

[22] Filed: Jul. 5, 1984

[51] Int. Cl.[4] ..... A47H 1/10

[52] U.S. Cl. ..... 248/205.8; D23/35

[58] Field of Search ..... 248/205.8, 75; D23/35; 239/548, 550, 282; 4/600, 608, 255, 256

[56] References Cited

U.S. PATENT DOCUMENTS

| | | | |
|---|---|---|---|
| 2,073,307 | 3/1937 | Isenberg | 239/282 |
| 2,095,170 | 10/1937 | Conklin | 248/75 |
| 2,276,779 | 3/1942 | Isenberg | D23/35 |
| 2,325,123 | 7/1943 | Isenberg | D23/35 |
| 2,785,010 | 3/1957 | Nelson | 239/548 |
| 2,873,999 | 2/1959 | Webb | D23/35 |
| 2,893,644 | 7/1959 | Holden | D23/35 |
| 3,020,017 | 2/1962 | Watson | 248/205.8 |
| 4,413,362 | 11/1983 | Chianco et al. | D23/35 |

FOREIGN PATENT DOCUMENTS

| | | | |
|---|---|---|---|
| 1945557 | 3/1971 | Fed. Rep. of Germany | 248/75 |
| 0091737 | 3/1938 | Sweden | 248/75 |

*Primary Examiner*—Ramon S. Britts
*Assistant Examiner*—Ramon O. Ramirez

[57] ABSTRACT

A movable support for a bathroom shower head with handle which handle is connected to a hose. This support provides flexibility of choice of horizontal, longitudinal and angular position of the shower head on a nonporous wall, limited in that position only by the length of the shower hose it supports. This has been achieved with a lever suction cup combined with a clamp. All major parts are constructed of durable plastic materials. This suction cup support allows continual change of position and can be moved from one shower hose to another.

7 Claims, 5 Drawing Figures

SUCTION CUP SUPPORT PARTICULARLY FOR A SHOWER HEAD WITH HANDLE AFFIXED TO A SHOWER HOSE

FIELD OF INVENTION

This invention relates to bathroom showers and specifically to a universal shower hose support with flexibility of position.

DISCUSSION OF PRIOR ART

Heretofore shower heads with handles affixed to shower hoses have been designed to be clamped to the conventional location of shower source above a standing person's head, or to be held by hand. The field of search showed no prior art patent for suction support of a shower head with handle affixed to a shower hose. However, two methods of support were found on the market unlike that proposed here. One is manufactured by Melard. It is a wall bracket for use with their "continental" shower (water source from a faucet). This bracket bolts or glues onto a wall. Its permanence at one spot is a disadvantage. The second is manufactured by Alsons. It is a vertical pipe bolted to the wall. The shower head with handle slides up and down this pipe offering different heights for the shower. Again, permanence on one wall is a disadvantage, and bolting into a tile wall in a rented apartment may be forbidden.

OBJECT OF THE INVENTION

The object of my invention is to have a shower hose handle support which is different and more versatile than previously known counterparts. It provides flexability of position and location for differing personal needs. A goal was to make showering easier and more convenient for the disabled, the aging, the infirm or anyone who cannot or should not be standing in one spot for an appreciable length of time. Such persons now could shower in a seated position. Children or adults whose height is incompatable with standard showers could also make use of this flexibility. Another object is to have a shower hose handle support that is compact in size, light in weight, easy to use, durable, safe, and inexpensive to mass produce. A working model has been in use for eleven months which has proven operable and reliable, fulfilling all expectations.

Further objects and advantages of this invention will become apparent from a consideration of the drawings and ensuing description thereof.

BRIEF DESCRIPTION OF THE DRAWINGS

The invention will be best understood with respect to the drawings wherein.

DETAILED DESCRIPTION

Reference to the drawings will show that in each of the figures like parts bear the same numerical designation.

Figure 1:
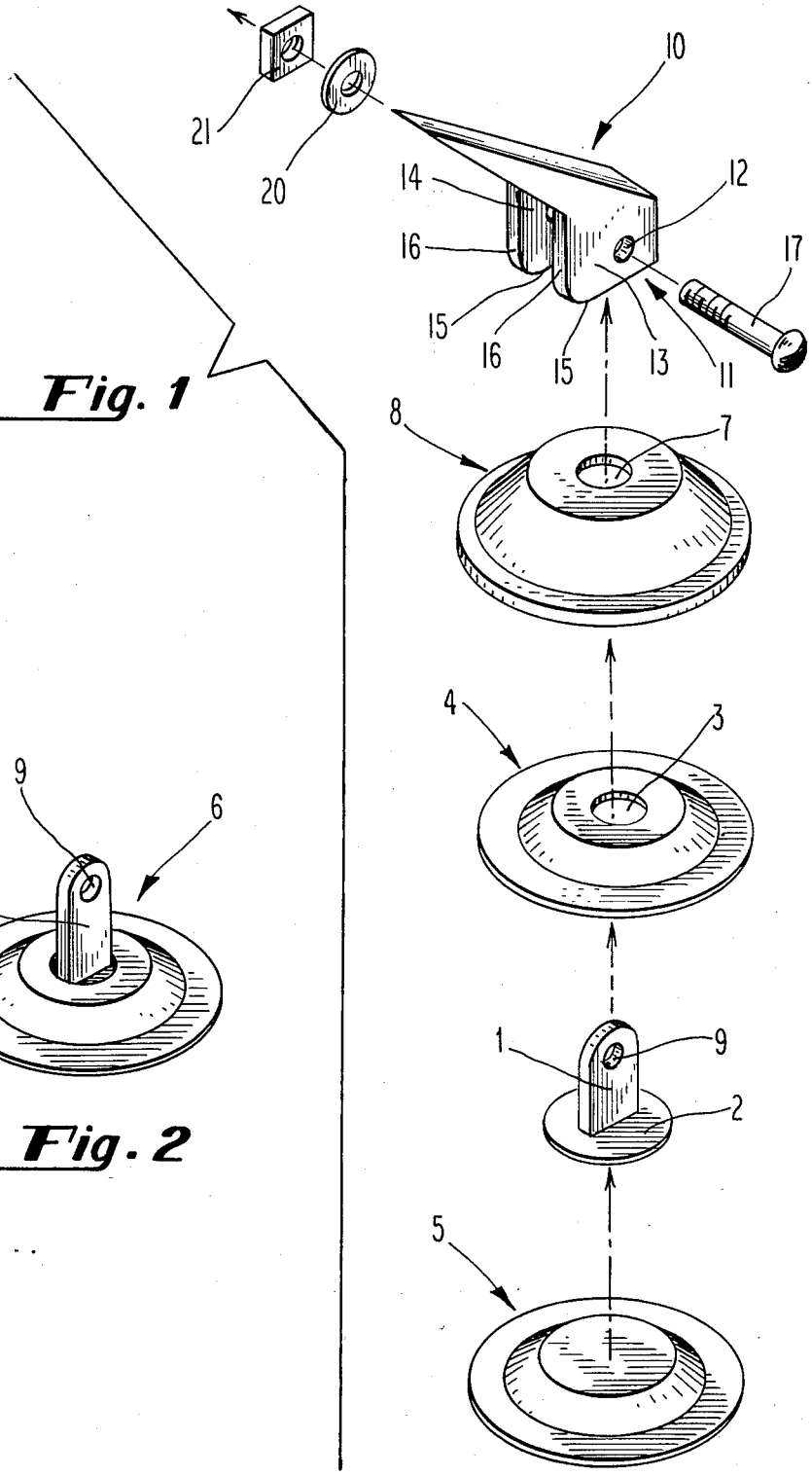
FIG. 1 shows an exploded view demonstrating the construction of the lever operated suction cup.

In the exploded view of FIG. 1 a hard plastic post 1 with an extended round base 2 is placed through an opening 3 of the middle of a flexible plastic diaphragm 4. A second flexible plastic diaphragm 5 of the same size as the diaphragm 4, but with no center opening, is molded to the bottom of diaphragm 4, the round base 2 of the post 1 fixed solidly between them. The result is one suction cup 6, FIG. 2, with post 1 extending from its top.

Figure 2:
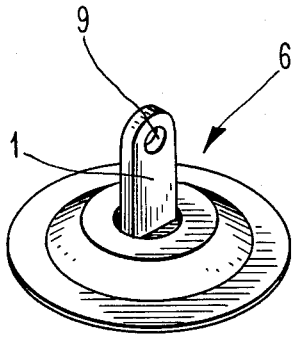
FIG. 2 shows the suction cup and post.

In FIG. 1 post 1 is then placed through the center opening 7 of a hard plastic cup 8 shaped similar to suction cup 6, FIG. 2, but large enough to cover suction cup 6. A hole 9 is formed through the top of post 1. A lever 10 with a base 11, open on the bottom 15 and on the adjacent side 16, is placed over post 1. Lever base 11 has a hole 12 through its two parallel sides 13 and 14. This hole 12 is closer to the bottom 15 of the lever base 11 than it is to the adjacent side 16 of the lever base 11. A bolt 17 fits loosely through the hole 12 on one side 13 of the lever base 11, through hole 9 in post 1 and through the corresponding hole of the parallel side 14 of lever base 11.

Figure 3:
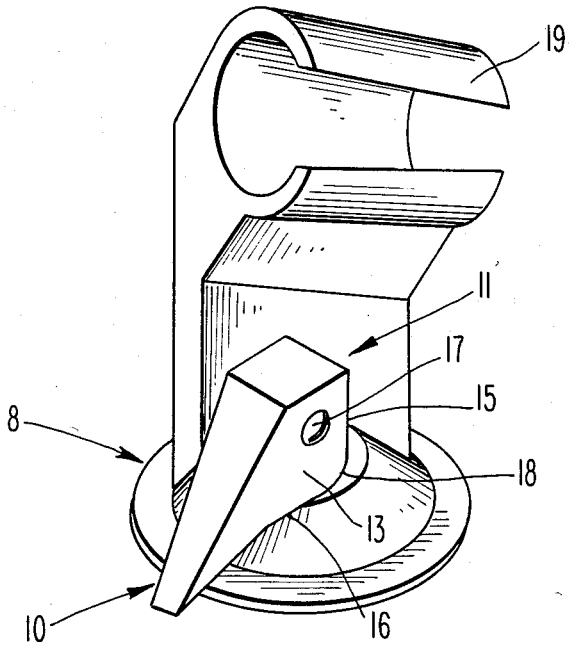
FIG. 3 shows the lever suction cup attached to the clamp with the lever in its tight position causing suction by pulling up the center of the suction cup.
Figure 4:
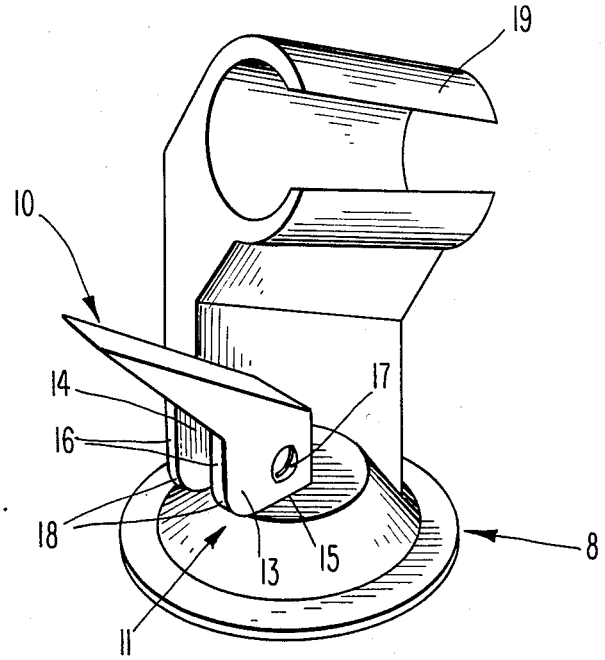
FIG. 4 shows the lever suction cup attached to the clamp with the lever in its loose position relaxing the suction cup.

The corners 18 between the bottom 15 and adjacent side 16 are rounded so that the lever 10 can turn the bottom 15, FIG. 4, or its adjacent side 16, FIG. 3, against the hard plastic cup 8. The bolt 17 can extend through the hard plastic clamp 19, FIGS. 3 and 4, or the clamp 19, FIGS. 3 and 4, can be molded as one piece with the hard plastic cup 8. The bolt 17 is fastened with a washer 20 and a nut 21, FIG. 1.

Figure 5:
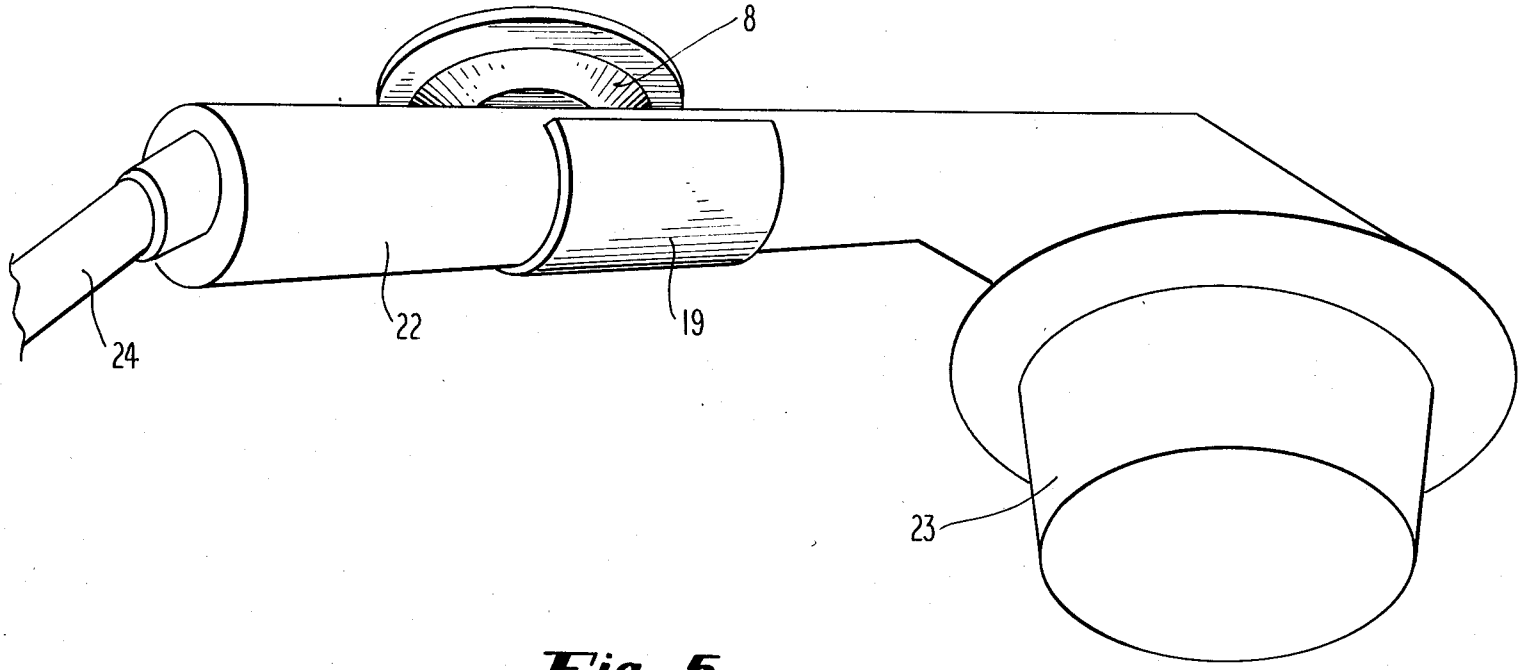
FIG. 5 shows a typical shower head, shower head handle and hose in operating position in clamp.

The handle 22, FIG. 5, of a shower head 23, FIG. 5, with hose 24, FIG. 5, is usually graduated in thickness, thinnest at the top next to the shower head 23. Similarly graduated, the plastic clamp 19, FIGS. 3 and 4, its narrowest part near the shower head 23, should be pressed onto the shower head handle 22, at the handle's thinnest part. The clamp 19, should then be moved toward thickest part of the shower head handle 22, to tighten the grip, FIG. 5. The shower head can then be suctioned to any nonpourous wall of a shower or bathtub at any height and at any angle, limited only by the length of the hose 24. The suction cup support, FIG. 3, is placed against the wall and the lever 10, FIG. 3, is moved so the post 1, secured by the bolt 17 moves away from the wall pulling the middle of the suction cup away from the wall causing a vacuum and a firm adherence to the wall. Moving the lever 10, FIG. 4, back again breaks the vacuum and causes an easy and immediate release. The suction cup support has a 360 degree choice of position on the wall. The clamp 19 allows the shower head 23 a 180 degree choice of position and direction of spray. This process works best when the shower head handle 22 is in a horizontal position.

Various modifications can be made without departing from the spirit of this invention or the scope of the appended claims. The constants set forth in this disclosure are given as examples and are in no way final or binding. In view of the above, it will be seen that the objects of the invention are achieved and other advantages are obtained. Many changes could be made in the above constructions and methods without departing from the scope of the invention. For example, the clamp could be molded as one piece with the hard plastic cup or bolted on. The dimensions of all parts can be changed so long as the principle is adhered to. The suction cup support can be a permanent part of the showerhead handle or removable. Other methods of friction can be used on the handle within the clamp such as a soft washer or a tightening bolt. Materials other than plastic can be used but I would recommend waterproof materials. Therefore, it is intended that all matter contained in the above description shall be interpreted as illustrative and not in any limiting sense.

It is claimed:

1. A movable support, particularly for use with a bathroom shower head having a handle and connected to a shower hose, comprising a suction cup having a post with a hole at the top of said post, a cover suction cup with a center opening for receiving said post, clamp means having a vertical base perpendicular to said suction cup, said base having a hole at its end closer to the suction cover cup and clamping means at its other end for securing the handle of the shower head, lever means, and securing means for securing the lever means to the clamp base and the letter to the post.

2. A movable support as defined in claim 1 wherein the cover suction cup is shaped similar to the suction cup but large enough to cover the suction cup.

3. A movable support as defined in claim 1 wherein the cover suction cup and the clamp means are made of hard plastic.

4. A movable support as defined in claim 1 wherein the clamping means are C-shaped.

5. A movable support as defined in claim 1 wherein the lever means has rounded corners to facilitate the turning of the lever against the plastic cup.

6. A movable support as defined in claim 1 wherein the securing means comprises a bolt, a washer and a nut.

7. A movable support as defined in claim 1, wherein the cover suction cup and the clamp means are molded as one unit.

* * * * *

UNITED STATES PATENT AND TRADEMARK OFFICE

CERTIFICATE OF CORRECTION

PATENT NO. : 4,580,751

DATED : April 8, 1986

INVENTOR(S) : Elinor S. Panzer

It is certified that error appears in the above-identified patent and that said Letters Patent are hereby corrected as shown below:

Column 4, line 2, change "letter" to -latter-.

Signed and Sealed this

First Day of July 1986

[SEAL]

*Attest:*

*Attesting Officer*

DONALD J. QUIGG

*Commissioner of Patents and Trademarks*